US009671080B2

(12) United States Patent
Seyrlehner et al.

(10) Patent No.: US 9,671,080 B2
(45) Date of Patent: Jun. 6, 2017

(54) LIGHTING DEVICE FOR A VEHICLE HEADLIGHT

(71) Applicant: ZIZALA LICHTSYSTEME GMBH, Wieselburg (AT)

(72) Inventors: Christian Seyrlehner, Ybbsitz (AT); Christoph Zeller, Purgstall (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 104 days.

(21) Appl. No.: 14/772,820

(22) PCT Filed: Mar. 4, 2014

(86) PCT No.: PCT/AT2014/050050
§ 371 (c)(1),
(2) Date: Sep. 4, 2015

(87) PCT Pub. No.: WO2014/134649
PCT Pub. Date: Sep. 12, 2014

(65) Prior Publication Data

US 2016/0010823 A1 Jan. 14, 2016

(30) Foreign Application Priority Data

Mar. 7, 2013 (AT) ..... 50158/2013

(51) Int. Cl.
*F21V 7/00* (2006.01)
*F21S 8/10* (2006.01)

(52) U.S. Cl.
CPC ..... *F21S 48/1747* (2013.01); *F21S 48/115* (2013.01); *F21S 48/1109* (2013.01);
(Continued)

(58) Field of Classification Search
CPC ..... F21S 48/1736; F21S 48/1742; F21S 48/1747; F21S 48/1109; F21S 48/115;
(Continued)

(56) References Cited

U.S. PATENT DOCUMENTS 8,967,843 B2 * 3/2015 Jackl ..... F21S 48/1109 362/246
2005/0122736 A1 6/2005 Watanabe et al.
(Continued)

FOREIGN PATENT DOCUMENTS

DE 102008011647 A1 9/2008
DE 102007040728 A1 3/2009
(Continued)

OTHER PUBLICATIONS

1st Office Action of Jan. 16, 2014 of the corresponding Austrian priority patent application A 50158/2013.
(Continued)

*Primary Examiner* — Andrew Coughlin
*Assistant Examiner* — Alexander Garlen
(74) *Attorney, Agent, or Firm* — Eversheds Sutherland (US) LLP

(57) ABSTRACT

The invention relates to a lighting device (1) for a motor vehicle headlight, wherein the lighting device (1) has at least one reflector (10, 11, 12, 13), and assigned to the at least one reflector (10, 11, 12, 13) is at least one light source (20, 21, 22, 23), and light from the at least one light source (20, 21, 22, 23) is radiated into a region in front of the lighting device (1) by means of the reflector (10, 11, 12, 13) in order to form a light distribution or a part of a light distribution. The lighting device (1) has at least one, preferably exactly one reflector support (30), and the at least one reflector (10, 11, 12, 13) is fixedly attached to the at least one reflector support (30), and the at least one light source (20, 21, 22, 23) is
(Continued)

Figure 1:
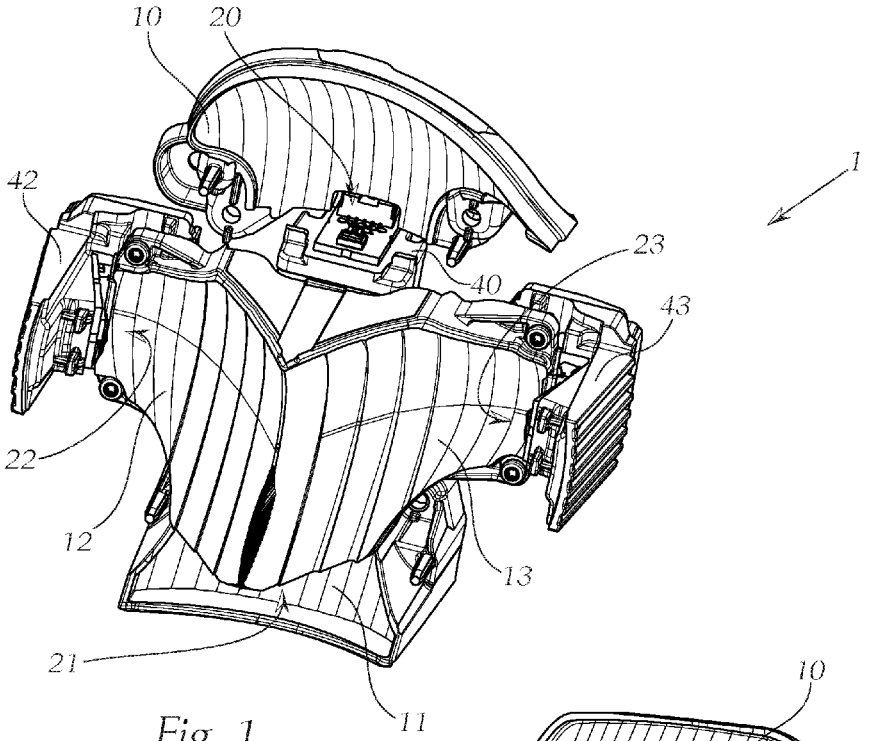

arranged on at least one light source support (40, 41, 42, 43), and the at least one light source support (40, 41, 42, 43) is movably mounted on the reflector support (30) and can be fixed in a defined position relative to the reflector support (30).

16 Claims, 4 Drawing Sheets

(52) U.S. Cl.
CPC ..... *F21S 48/1159* (2013.01); *F21S 48/1305* (2013.01); *F21S 48/137* (2013.01); *F21S 48/1352* (2013.01); *F21S 48/328* (2013.01)

(58) Field of Classification Search
CPC .... F21S 48/1159; F21S 48/13; F21S 48/1305; F21S 48/1352; F21S 48/137; F21S 48/1388; F21S 48/328
See application file for complete search history.

(56) References Cited

U.S. PATENT DOCUMENTS

| | | | | |
|---|---|---|---|---|
| 2005/0122737 | A1* | 6/2005 | Watanabe | B60Q 1/0041 362/544 |
| 2006/0215416 | A1* | 9/2006 | Lucas | B60Q 1/076 362/545 |
| 2007/0076420 | A1* | 4/2007 | Hayashi | B60Q 1/0041 362/514 |
| 2007/0076422 | A1* | 4/2007 | Nicolai | B60Q 1/0041 362/547 |
| 2008/0112180 | A1* | 5/2008 | Okada | F21S 48/1154 362/518 |
| 2012/0314439 | A1* | 12/2012 | Uchida | F21S 48/1159 362/512 |

FOREIGN PATENT DOCUMENTS

| | | | |
|---|---|---|---|
| DE | 102009030564 | A1 | 12/2010 |
| DE | 102010048596 | A1 | 4/2012 |
| DE | 10201054922 | A1 | 6/2012 |
| EP | 1170546 | A1 | 1/2001 |
| EP | 2532951 | A2 | 12/2012 |
| EP | 2620693 | A2 | 7/2013 |
| FR | 2955171 | A1 | 7/2011 |
| WO | 2012028170 | A1 | 3/2012 |

OTHER PUBLICATIONS

English translation of the International Preliminary Report on Patentability of the corresponding international patent application PCT/AT2014/050050.

* cited by examiner

LIGHTING DEVICE FOR A VEHICLE HEADLIGHT

The invention relates to a lighting device for a motor vehicle headlight, wherein the lighting device has at least one reflector, and assigned to the at least one reflector is at least one light source, and light from the at least one light source is radiated into a region in front of the lighting device by means of the reflector in order to form a light distribution or a part of a light distribution.

The invention also relates to a vehicle headlight having at least one such lighting device.

LED light sources consisting of one or more light-emitting diodes are being used to an increasing extent in vehicle headlight construction, in order to generate a main light distribution, such as a high-beam light distribution, dimmed light distributions, e.g., low-beam light, etc. In these cases, the light is usually radiated from one or more LED light sources via one or more reflectors into a region in front of the motor vehicle, in which the vehicle headlight is installed, and illuminates the region in front of the vehicle.

In order to achieve a legal light distribution, it is important for the reflector and the associated light source(s) to be positioned correctly relative to one another. This issue becomes even more significant, in particular, when LED light sources are used, since, in this case, even relatively slight deviations from the desired position can result in unwanted and/or impermissible effects in the light pattern.

The LED light source(s) is or are usually arranged on a support, which is typically a cooling body. The LED light source(s) is or are seated on an LED printed circuit board in this case, which, in turn, is arranged on the support, e.g., being bonded thereto. The associated reflector is positioned accordingly and is then fixed at the support or relative to the support, usually being screwed thereto or to another fixed component.

Many times it has been shown, however, that the fastening procedure can cause the reflector to warp, in particular due to the forces resulting from the reflector being screwed on tightly or, in general, the reflector can become unintentionally moved out of the optimal position during the fastening procedure. This has disadvantageous effects on the light pattern that is obtained, in some cases with the result that the light pattern no longer conforms to the legal requirements.

A problem addressed by the invention is that of creating a lighting device or a motor vehicle headlight, in which a reliable adjustment of the reflector and the associated light source or the associated light sources can be easily carried out, wherein the above-described disadvantages are eliminated. This problem is solved, according to the invention, with an initially mentioned lighting device or with a vehicle headlight, which has at least one such lighting device, in that the lighting device has at least one, preferably exactly one reflector support, and the at least one reflector is fixedly attached to the at least one reflector support, and the at least one light source is arranged on at least one light source support, and the at least one light source support is movably mounted on the reflector support and can be fixed in a defined position relative to the reflector support. According to the present invention, the reflector is no longer arranged relative to the fixed light source; instead, the reflector is first fastened on a reflector support, which can be designed to be solid, and the light source, which is seated on a light source support, is then positioned accordingly and, finally, the light source support is fixed relative to the reflector support. For the sake of simplicity, the singular form (the reflector, the light source, etc.) is always used here, although a person skilled in the art understands that a plurality of reflectors, light sources, light source supports, etc., can also be provided.

Given that both the reflector support and the light source support can be designed as solid components or are preferably designed to be solid, fixing these components relative to one another does not result in disadvantageous effects on the light pattern.

In order to permit optimal dissipation of the heat generated by the light sources, it has proven advantageous for the at least one reflector support to be designed as the main cooling body.

It has also proven advantageous for the at least one light source support to be designed as a light source cooling body.

The embodiment of the reflector support and the light source support(s) has the advantage, in addition to the optimal dissipation of the resultant heat, that the cooling bodies are usually solid metal bodies, which are therefore also optimally suited for fixing to one another within the sense of the invention.

An adjustment of the light pattern in the vertical direction is usually particularly significant. It is therefore provided in a specific embodiment of the invention that the at least one light source support—in the installed position of the lighting device—can be moved vertically relative to the at least one reflector support.

According to a specific embodiment, which is easy to produce and permits exact adjustment and stable positioning in the final position, the at least one reflector support for the at least one light source support has at least one guide groove/at least one guide peg and the at least one light source support has at least one corresponding guide peg/at least one corresponding guide groove.

Due to the use of a peg guided in a groove, it is ensured that displacement is possible only in the direction of the groove, while displacement laterally thereto is prevented. By this reduction of the degrees of freedom, the desired position can be quickly set and the number of unwanted possible positions is greatly reduced.

In this case, the at least one guide groove is preferably formed on the reflector support and the at least one corresponding guide peg is arranged on the at least one light source support.

In order to permit simple displacement, it is advantageously provided that the at least one guide groove is elongated and extends in a straight line.

In order to permit adjustment of the light pattern in the vertical direction, the at least one guide groove extends vertically, in the installed position of the lighting device.

It is also advantageously provided that the at least one guide peg is elongated and straight and extends in the direction of the corresponding guide groove.

Instead of an elongated guide peg, it is also possible to provide two (or more) pegs, which are guided in the guide groove and which do not have an elongated extension, but rather "merely" protrude, e.g., are designed as rounded high spots.

Typically, exactly one guide groove and exactly one corresponding guide peg are provided for each light source support.

In order to permit a uniform and reliable fixation of a light source support on the reflector support, it is provided in a specific embodiment of the invention that the at least one guide groove or the at least one guide peg is interrupted by a fastening opening for fastening the light source support on the reflector support.

A guide groove (or the exactly one guide groove) and a guide peg (or exactly one guide peg) are therefore two-pieced.

In this manner, the light source support can be connected via the central region thereof and, therefore, as evenly as possible, to the reflector support, in particular being pressed thereon.

In a specific embodiment of the invention, two or more reflectors are provided, wherein assigned to each reflector is exactly one light source support, each of which has at least one light source, and the light source supports can be moved and fixed relative to the at least one reflector support.

In addition, exactly one reflector support is provided, and all light source supports are movably mounted and are fixable on the one reflector support.

In principle, it is conceivable that two or more reflector supports can also be provided for one or more reflectors in each case, although a simpler design is usually to provide exactly one reflector support.

In particular, the lighting device comprises exactly four reflectors and exactly four assigned light source supports, e.g., in order to generate a high-beam light distribution and a dimmed light distribution, such as a low-beam distribution, with the lighting device.

Advantageously, the light sources are LED light sources, wherein each LED light source includes at least one, e.g., exactly one light-emitting diode.

It is advantageous, in particular, when each LED light source or at least the LED light sources of different reflectors can be separately activated and switched on or off and/or dimmed, wherein, preferably, each light-emitting diode of an LED light source can be separately activated and switched on or off and/or dimmed.

According to a preferred embodiment, at least one of the reflectors is a high-beam reflector for generating a high-beam light distribution or a part of a high-beam light distribution.

As an alternative or in addition to this preferred embodiment, it can be provided that at least one of the reflectors is a low-beam light reflector for generating a low-beam light distribution or a part of a low-beam light distribution.

The use of low-beam light distribution and/or high-beam light distribution, in particular, results in advantages, in particular, in respect of the vertical adjustability of the light sources, as is explained in greater detail in the description of the figures.

Figure 2:
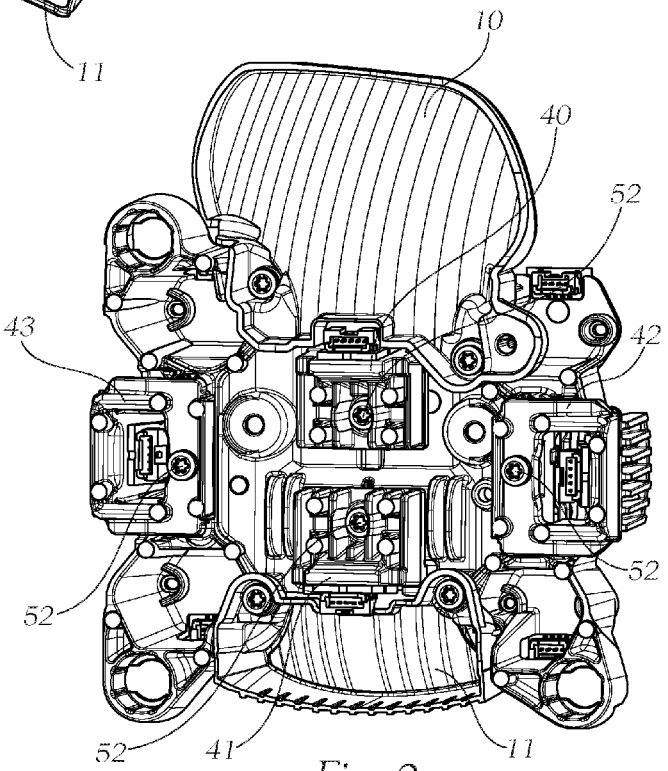
Figure 3:
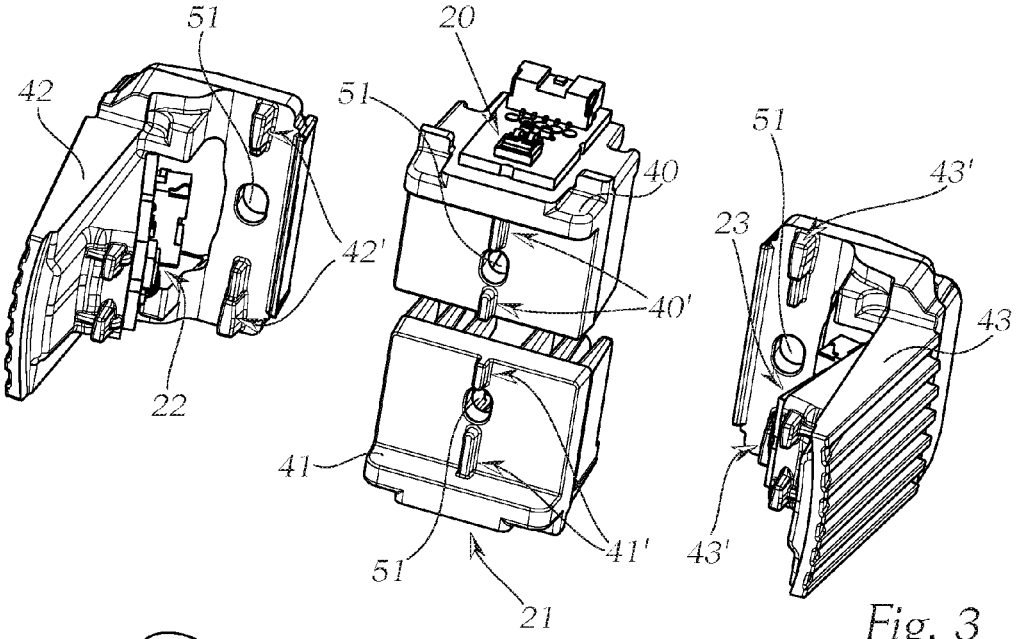
Figure 4:
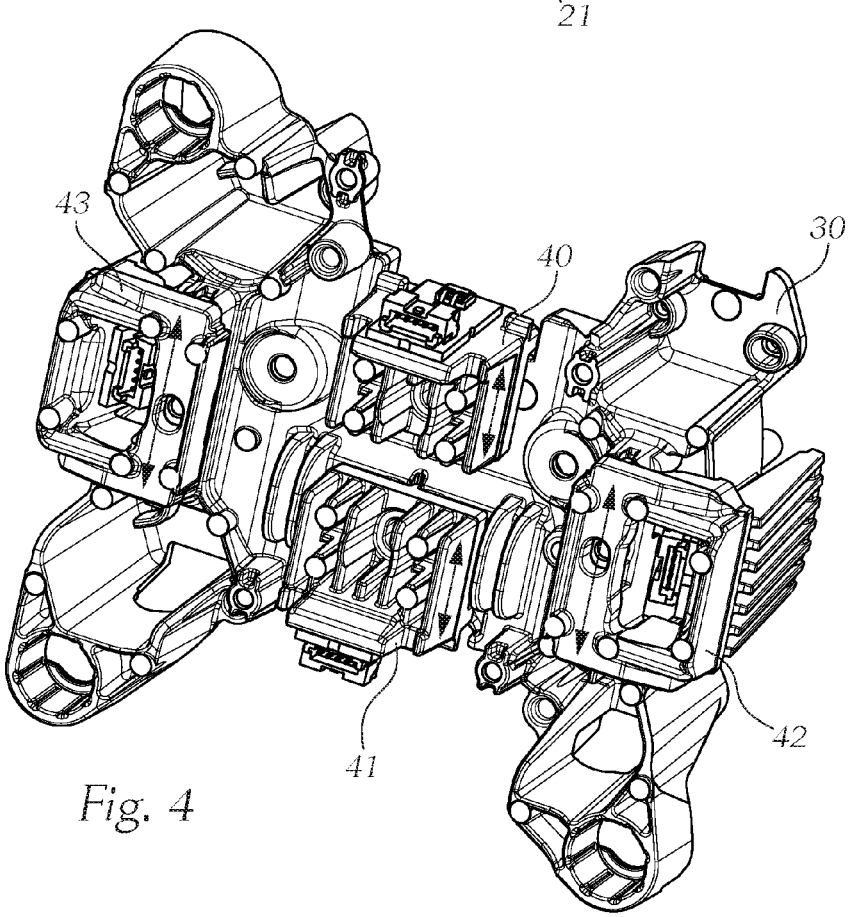
Figure 5:
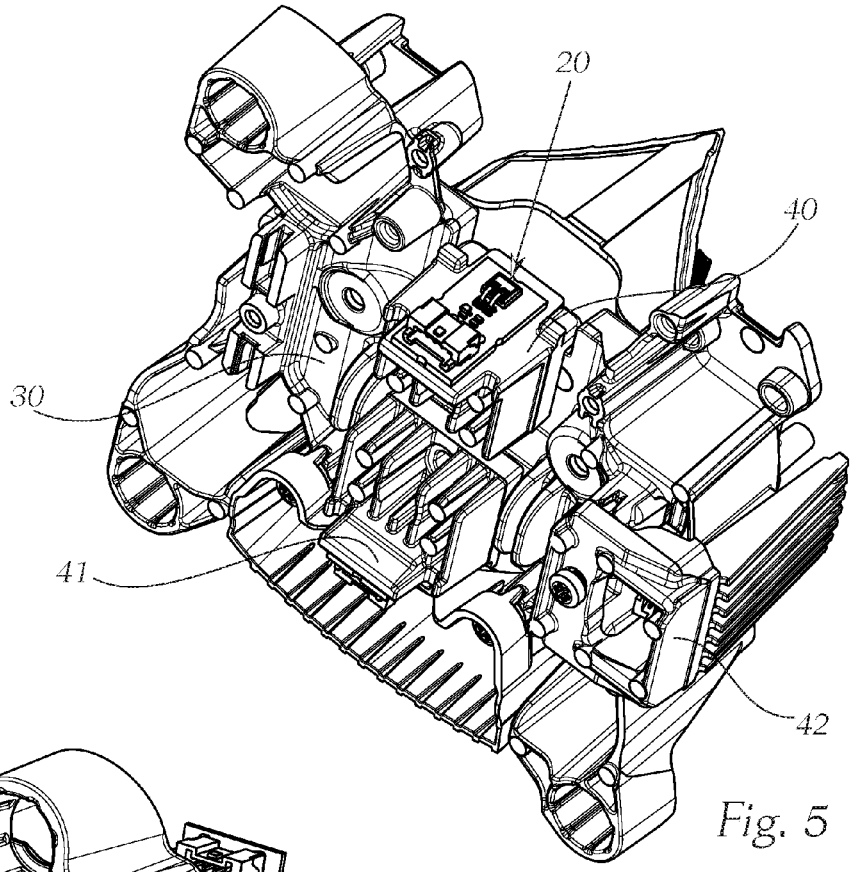
Figure 6:
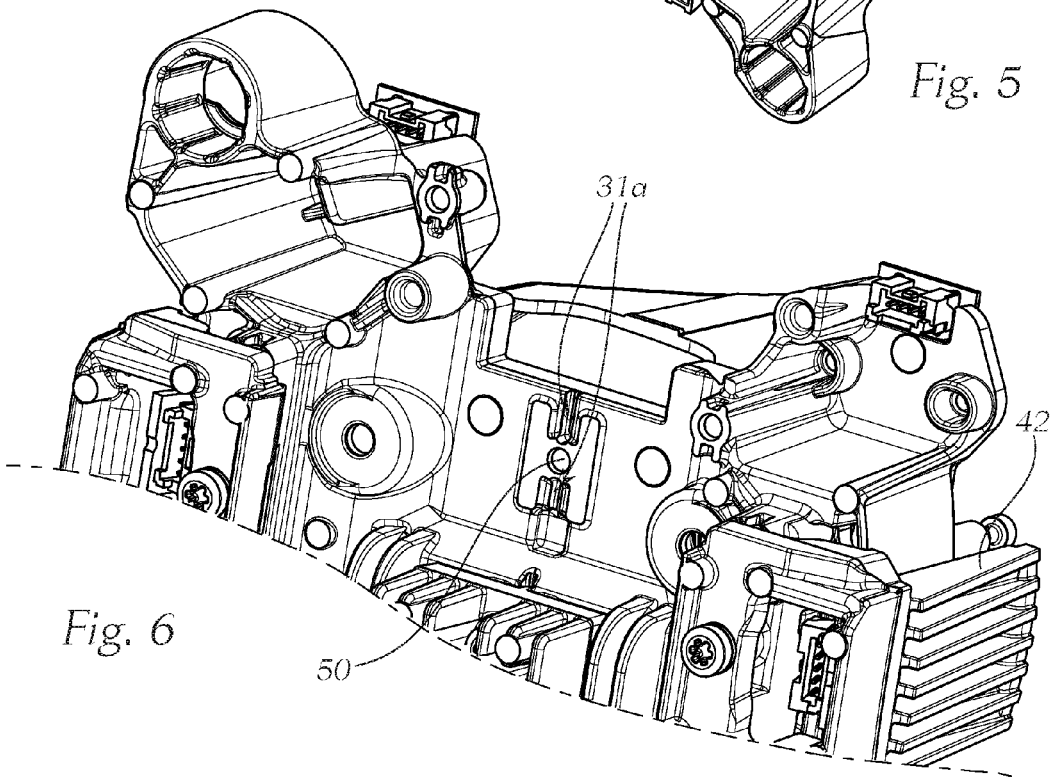
Figure 7:
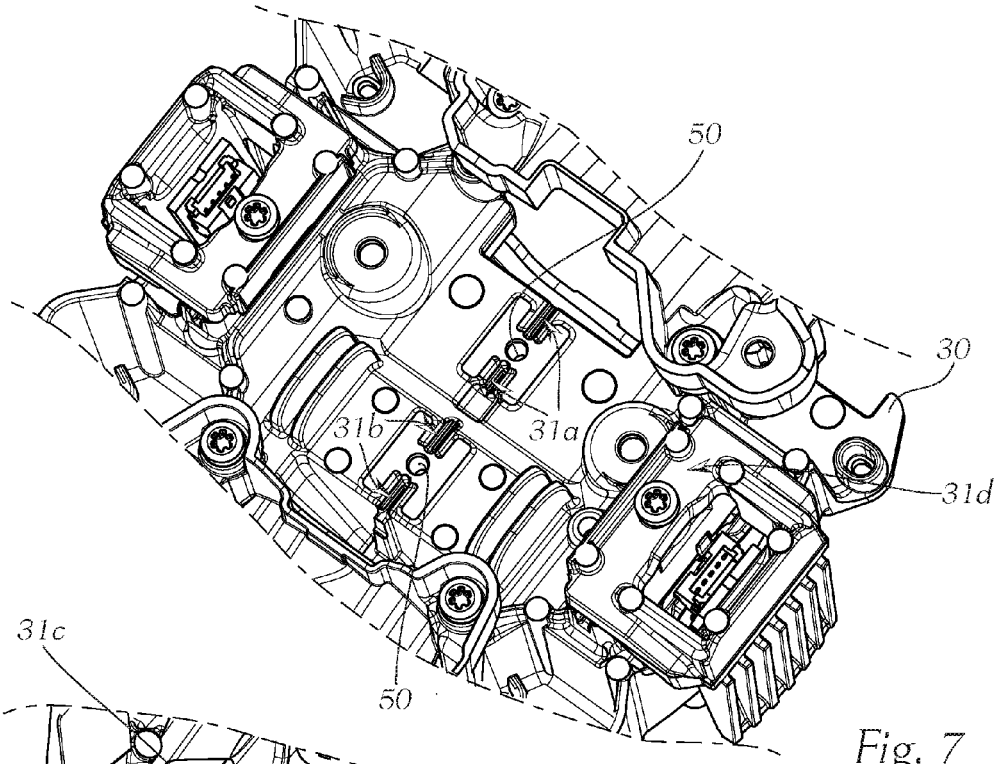
Figure 8:
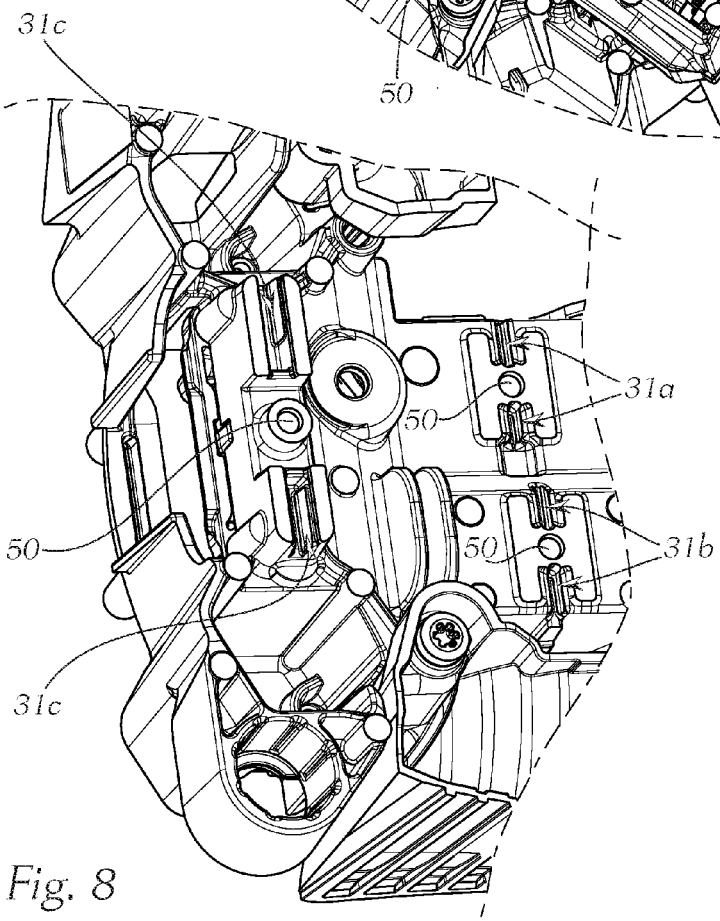

The invention is explained in greater detail in the following with reference to the drawings. In the drawings:

FIG. 1 shows a schematic front view of a lighting device according to the invention, shown without the reflector support, FIG. 2 shows a rear view of the lighting device from FIG. 1, shown with the reflector support, FIG. 3 shows a view from the front of the light source cooling body of the lighting device having LED light sources, FIG. 4 shows a view from the rear of the reflector support having the light source cooling bodies, FIG. 5 shows the reflector support in the region of the upper light source cooling body, FIG. 6 shows the illustration from FIG. 5, with the upper light source cooling body removed, FIG. 7 shows the reflector support in the region of the guide grooves for the upper and the lower light source cooling body, and FIG. 8 shows the reflector support in the region of the guide grooves for a lateral light source cooling body.

FIG. 1 shows a schematic illustration of a lighting device 1 for a motor vehicle headlight, wherein the lighting device 1 comprises four reflectors 10, 11, 12, 13 in the exemplary embodiment shown. A light source 20, 21, 22, 23 is assigned to each of the four reflectors 10, 11, 12, 13, respectively.

The light sources 20, 21, 22, 23 are LED light sources, wherein each LED light source 20, 21, 22, 23 comprises at least one light-emitting diode.

In the present example, each LED light source 20, 21, 22, 23 consists of a chip, on each of which 4 light-emitting diodes are seated. In the present example, one LED light source therefore includes 4 light-emitting diodes in each case.

Preferably, the LED light sources 20, 21, 22, 23 assigned to different reflectors 10, 11, 12, 13 can be separately activated and switched on or off and/or dimmed, thereby making it possible to supply different reflectors with light and activate different light distributions accordingly.

Light from the light source 20, 21, 22, 23 assigned to one of the reflectors 10, 11, 12, 13 is radiated into a region in front of the lighting device 1 in order to form a light distribution or a part of a light distribution. In the example shown, the upper and the lower reflector 10, 11 in combination generate a high-beam light distribution, while the two side reflectors 12, 13 in combination generate a low-beam light distribution. The reflectors 12, 13 are designed as double reflectors, see also the remarks at the end of the description in this regard.

The four reflectors 10, 11, 12, 13 are arranged on a reflector support 30, fixedly fastened on the reflector support 30. "Fixedly" fastened "on the reflector support" means that the reflectors are fixedly arranged relative to the support 30, wherein the reflectors are preferably fastened directly on the support 30, e.g., being screwed thereon, as is clearly shown in FIG. 2.

The reflector support 30 is preferably designed as a cooling body, via which the heat generated by the light sources 20, 21, 22, 23 can be dissipated.

In turn, each of the light sources 20, 21, 22, 23 is arranged on a separate, preferably substantially smaller light source support 40, 41, 42, 43, wherein these four light source supports 40, 41, 42, 43 are preferably designed as (four) cooling bodies.

FIG. 3 shows a front view of the four light source supports 40, 41, 42, 43 separately, FIG. 4 shows the four light source supports 40, 41, 42, 43 and the reflector support 30. According to the invention, the light source supports 40, 41, 42, 43 are movably mounted on the reflector support 30 and can be fixed in a defined position relative to the reflector support 30.

Generally within the scope of the present invention, and not only for the example described here, this means that the expression that a light source support is movably mounted on the reflector support means that the light source support is movable relative to the reflector support, wherein the light source support is preferably movably mounted directly on the reflector support.

In FIG. 4, the vertical direction (based on the installed position of the lighting unit 1 in a vehicle), in which the light source supports 40, 41, 42, 43 in the example shown can be moved, is indicated by arrows.

Reference is made once more to FIGS. 3 and 4 as well as 5-8 in the following:

In order to permit the light source supports 40, 41, 42, 43 to be easily displaced in the vertical direction on the reflector support 30, the reflector support 30 has a guide groove 31*a*, 31*b*, 31*c*, 31*d*, namely preferably exactly one guide groove for each light source support 40, 41, 42, 43. The guide grooves 31*a*, 31*b*, 31*c*, 31*d* are two-pieced, and therefore reference can also be made to two grooves per light source support. Each of the guide grooves 31*a*, 31*b*, 31*c*, 31*d* is interrupted by a fastening opening 50, via which the respective light source support can be fastened on the reflector support. The fastening opening is a pre-bored hole, for example, or, if the reflector support is cast, the reflector support is provided with this hole during the casting process.

Every light source support 40, 41, 42, 43 has, on the side thereof facing or resting against the reflector support 30, a guide peg 40', 41', 42', 43' corresponding to the guide groove 31*a*, 31*b*, 31*c*, 31*d*, by means of which said guide peg the light source support is guided in the associated groove.

The guide pegs 40', 41', 42', 43' are also interrupted by a fastening opening 51 for fastening the respective light source support 40, 41, 42, 43 on the reflector support 30, and therefore it can also be stated here that two pegs (or one interrupted peg) are provided per light source support. The fastening openings 51 in the light source supports 40, 41, 42, 43 are preferably slots, which extend in the displacement direction of the light source support, and through which slots the light source support can be fixed to the reflector support 30 in the desired, set position by means of a screw 52.

The screws 52 are preferably self-tapping screws, as explained above, which screw themselves into the reflector support during the screw-in process.

Due to the use of a peg guided in a groove, it is ensured that displacement is possible only in the direction of the groove, while displacement laterally thereto is prevented. By this reduction of the degrees of freedom, the desired position can be quickly set and the number of unwanted possible positions is greatly reduced.

The guide grooves 31*a*, 31*b*, 31*c*, 31*d* are elongated and extend in a straight line in the vertical direction, as do the guide pegs.

The reflectors are fastened on the reflector support before the light sources are adjusted, thereby ensuring that forces do not act on the reflectors when the light sources are adjusted, which ensures that said reflectors are not displaced in an unwanted manner.

The reflector support, in particular in the form of a cooling body, can be designed as a metal part, e.g., as an aluminum diecast part, thereby making it possible to design the guide grooves very exactly. Correspondingly, the position of the light sources can be set exactly and the position of the light sources no longer changes relative to the respectively assigned reflector, even during fastening.

In addition, double or multiple reflectors can also be used in the present invention. Reflectors usually must be adjusted separately, which is not possible in the case of double and multiple reflectors. Due to the adjustment of the light sources according to the invention, it is no longer necessary to adjust the reflectors, thereby making it possible to also use double and multiple reflectors.

In the present invention, see FIG. 1, in particular, the two low-beam light reflectors 12, 13 are designed as a double reflector, i.e., the two reflectors 12, 13 are formed in one component.

In principle, it is conceivable that two or more reflector supports can also be provided for one or more reflectors in each case, e.g., each light source support could be movably mounted on a separate reflector support and the four reflector supports are fixedly interconnected, although it is usually structurally simpler to provide exactly one reflector support, as shown.

Finally, it is preferably also provided that the surfaces of the guide grooves, at which the light source supports are movably guided, are milled and, if necessary, the surfaces thereof are treated in order to obtain particularly flat surfaces, thereby enabling the light source supports to be easily displaced.

Moving the light sources 20, 21 up and down in the vertical direction (i.e., up and down; the directions are always relative to the installed position of the headlight), which light sources are assigned to the high-beam reflectors 10, 11 (i.e., the light thereof radiates onto these reflectors), causes the size of the high-beam spot to change. The size of the high-beam light distribution can therefore be optimally adjusted by moving the light sources 20, 21 assigned to the high-beam reflectors 10, 11.

The vertical (up and down) displacement of the light sources 22, 23 of the low-beam light reflectors primarily 12, 13 to a focussing or defocussing of the light-dark boundary of the low-beam light distribution generated with these reflectors and, secondarily, to a slight up and down movement of the light distribution, thereby making it possible to adjust the position of the low-beam light distribution and the sharpness of the light-dark boundary accordingly via the vertical displacement of these light sources 12, 13.

The aforementioned effects were discussed on the basis of the specific embodiment having four reflectors, although these effects are not limited to this specific number. It is also possible to provide more reflectors, and the effects also result, e.g., when only one high-beam reflector having assigned, vertically displaceable light sources and/or a low-beam light reflector having an assigned, vertically displaceable light source is/are provided.

The invention claimed is:

1. A lighting device for a motor vehicle headlight, the lighting device comprising:

at least one reflector;

at least one light source assigned to the at least one reflector, wherein light from the at least one light source is radiated into a region in front of the lighting device by means of the at least one reflector in order to form a light distribution or a part of a light distribution;

exactly one reflector support, and wherein the at least one light source is arranged on at least one light source support, and wherein the at least one light source support is movably mounted on the reflector support and can be fixed in a defined position relative to the reflector support, wherein two or more reflectors are provided, wherein assigned to each reflector is exactly one light source support, each of which has at least one light source, and wherein the two or more reflectors are fixedly fastened on the reflector support wherein all the light source supportscan be moved and fixed relative to the reflector support, wherein the at least one reflector support for the at least one light source support comprises at least one guide groove/at least one guide peg, at which the light source support is movably guided and the at least one light source support comprises at least one corresponding guide peg/at least one corresponding guide groove, wherein the at least one guide groove and the at least one guide peg is interrupted by a fastening opening for fastening the light source support on the reflector support, wherein the fastening opening in the at least one light source support is designed as a slot.

2. The lighting device of claim 1, wherein the at least one reflector support is designed as a main cooling body.

3. The lighting device of claim 1, wherein the at least one light source support is designed as a light source cooling body.

4. The lighting device of claim 1, wherein the at least one light source support, when the lighting device is in an installed position, can be moved vertically relative to the at least one reflector support.

5. The lighting device of claim 1, wherein the at least one guide groove is formed on the reflector support and the at least one corresponding guide peg is arranged on the at least one light source support.

6. The lighting device of claim 5, wherein the at least one guide groove is elongated and extends in a straight line.

7. The lighting device of claim 6, wherein the at least one guide groove, when the lighting device is in an installed position, is arranged so as to extend vertically.

8. The lighting device of claim 1, wherein the at least one guide peg is elongated and straight, and extends in the direction of the corresponding guide groove.

9. The lighting device of claim 1, wherein exactly one guide groove and exactly one corresponding guide peg are provided for each light source support.

10. The lighting device of claim 1, which comprises exactly four reflectors and exactly four assigned light source supports.

11. The lighting device of claim 1, wherein the light sources are LED light sources, wherein each LED light source comprises at least one light-emitting diode.

12. The lighting device of claim 11, wherein each LED light source or at least the LED light sources of different reflectors can be separately activated and at least one of switched on or off and dimmed.

13. The lighting device of claim 1, wherein at least one of the reflectors is a high-beam reflector for generating a high-beam light distribution or a part of a high-beam light distribution.

14. The lighting device of claim 1, wherein at least one of the reflectors is a low-beam reflector for generating a low-beam light distribution or a part of a low-beam light distribution.

15. A vehicle headlight comprising at least one lighting device of claim 1.

16. The lighting device of claim 12, wherein each light-emitting diode of the LED light source can be separately activated and at least one of switched on or off and dimmed.

* * * * *